US011345000B2

(12) United States Patent
Chen

(10) Patent No.: US 11,345,000 B2
(45) Date of Patent: May 31, 2022

(54) PLIERS

(71) Applicant: Jin Fu Chen, Taichung (TW)

(72) Inventor: Jin Fu Chen, Taichung (TW)

( * ) Notice: Subject to any disclaimer, the term of this patent is extended or adjusted under 35 U.S.C. 154(b) by 638 days.

(21) Appl. No.: 16/419,330

(22) Filed: May 22, 2019

(65) Prior Publication Data

US 2019/0270185 A1 Sep. 5, 2019

Related U.S. Application Data

(63) Continuation-in-part of application No. 15/471,331, filed on Mar. 28, 2017, now abandoned.

(51) Int. Cl.
*B25B 7/04* (2006.01)
*B25B 7/10* (2006.01)

(52) U.S. Cl.
CPC . *B25B 7/04* (2013.01); *B25B 7/10* (2013.01)

(58) Field of Classification Search
CPC .. B25B 5/04; B25B 5/166; B25B 7/04; B25B 7/10; B25B 9/04
USPC ..... 81/409.5
See application file for complete search history.

(56) References Cited

U.S. PATENT DOCUMENTS

2004/0159194 A1 8/2004 Ting
2005/0262974 A1* 12/2005 Engvall ..... B25B 7/10 81/413
2012/0111157 A1 5/2012 Qiu

FOREIGN PATENT DOCUMENTS

TW M507287 U 9/2015

* cited by examiner

*Primary Examiner* — David B. Thomas
*Assistant Examiner* — Aaron R McConnell
(74) *Attorney, Agent, or Firm* — Bradley J. Thorson; DeWitt LLP

(57) ABSTRACT

A pliers has guiding surfaces at tooth portions of the first pliers body and tooth portions of the engaging unit of the control member. Therefore, when the pressing block of the control member is not pressed, even if the first pliers body is engaged with the tooth portions of the engaging unit, the second pliers body can still be pushed forward relative to the first pliers body, so that the second guiding surfaces of the second tooth portions of the engaging unit slide relative to the first guiding surfaces of the first tooth portions and each of the first tooth portions is moved to engage with a next corresponding second tooth portion, thereby allowing the second pliers portion being movable toward the first pliers portion. Hence, the clamping distance of the pliers can be adjusted to match with an object to be clamped.

8 Claims, 16 Drawing Sheets

PLIERS

This Application is being filed as a Continuation-in-Part of U.S. patent application Ser. No. 15/471,331, filed Mar. 28, 2017, currently pending.

BACKGROUND OF THE INVENTION

Field of the Invention

The present invention relates to a pliers, in particular to a pliers in which the clamping distance of the pliers is adjustable.

Description of the Prior Art

As shown in FIGS. 15 and 16, a conventional pliers includes two pliers body 91, 92 stacked with each other and pivoted relative to each other. The pliers body 91 has an elongate tooth groove 93. The pliers body 92 has a pivot shaft 95 received in the tooth groove 93, and the pivot shaft 95 has a tooth portion 94. As shown in FIG. 16, the pivot shaft 95 can be moved in the tooth groove 93 by pressing manually, so that the tooth portion 94 is detached from the tooth groove 93, and the pliers body 92 is slidable relative to the pliers body 91 to adjust the clamping distance of the pliers. When the pivot shaft 94 is not pressed, the pivot shaft 95 is moved resiliently and the tooth portion 94 is engaged in the tooth groove 93 to position the pivot shaft 95, so that a user can clamp an object with the clamping distance.

Accordingly, when the clamping distance of the pliers is to be adjusted, the user has to use his/her finger to press the pivot shaft 95 to allow the tooth portion 94 to detach from the tooth groove 93, so that the pliers bodies 91, 92 are slidable relative to each other. However, when the object to be clamped by the pliers is in a limited space, in the case that the user cannot let his/her arm into the space, even if the pliers itself can be placed in the space to reach the object, the user still cannot press the pivot shaft 95 in the space. As a result, the user has to adjust the clamping distance of the pliers by a visual measurement of the object or by intuition, and then inserts the pliers into the space to check if the adjusted clamping distance matches the size of the object. In practice, the user has to adjust the clamping distance of the pliers several times before the pliers clamps the objects. Consequently, the operation of the conventional pliers is inconvenient.

SUMMARY OF THE INVENTION

One object of the present invention is to solve the aforementioned problem and to provide a pliers in which the pliers can be operated conveniently in a limited space for clamping an object.

In view of these objects, the present invention provides a pliers comprising:

a first pliers body, wherein two ends of the first pliers body are respectively a first pliers portion and a first handle portion, an operating portion is between the first pliers portion and the first handle portion, the operating portion has an elongate hole defined therethrough, and the operating portion has several first tooth portions around two sides of the elongate hole in a width direction of the elongate hole, the first tooth portions protrude from the operating portion in an opening direction of the elongate hole and are parallel arranged along a length direction of the elongate hole, wherein each of the first tooth portions has a first guiding surface opposite to the first pliers portion and a first stopping surface facing the first pliers portion, and each of the first tooth portions tilts toward the elongate hole in a width direction of the operating portion;

a second pliers body, wherein two ends of the second pliers body are respectively a second pliers portion and a second handle portion, a through hole is between the second pliers portion and the second handle portion, the through hole of the second pliers body is aimed at the elongate hole of the first pliers body, and the second pliers body is stacked on the first pliers body in a cross manner; and a control member having a rod portion, wherein an outer diameter of the rod portion is less than a width of the elongate hole, two ends of the rod portion respectively have a pressing block and an engaging unit, the engaging unit has several second tooth portions capable of being engaged with the first tooth portions, each of the second tooth portions has a second guiding surface and a second stopping surface, the second guiding surfaces correspond to the first guiding surfaces and are respectively slidable relative to the first guiding surfaces, the second stopping surfaces correspond to the first stopping surfaces and the first stopping surfaces are respectively stopped by the second stopping surfaces, the rod portion of the control member passes through the through hole and the elongate hole, when the pressing block is abutted against an elastic member, the pressing block is normally pushed away from the operating portion and the second tooth portions of the engaging unit are normally engaged with the first tooth portions of the operating portion;

wherein the pressing block is pressable toward the operating portion until the second tooth portions of the engaging unit are detached from the first tooth portions, so that the second pliers body is capable of being pushed forward or pulled backward relative to the first pliers body, thereby allowing the second pliers portion moving close to or away from the first pliers portion, wherein when the second pliers portion is away from the first pliers portion and the second tooth portions of the engaging unit are engaged with the first tooth portions of the operating portion, the second pliers body is capable of being pushed forward relative to the first pliers body without pressing the pressing block, so that the second guiding surfaces of the second tooth portions of the engaging unit slide relative to the first guiding surfaces of the first tooth portions and each of the first tooth portions is moved to engage with a next corresponding second tooth portion, thereby allowing the second pliers portion being movable toward the first pliers portion; wherein when the second pliers body is pulled backward relative to the first pliers body without pressing the pressing block, the second stopping surfaces of the second tooth portions are stopped by the first stopping surfaces of the first tooth portions, and the second pliers portion is not moved away from the first pliers portion.

In one embodiment, the second pliers body has a stepped surface corresponding to the pressing block, wherein the elastic member is a compression spring, and two ends of the compression spring are respectively abutted against the pressing block and the stepped surface.

In one embodiment, the elastic member is a compression spring in which the two ends of the compression spring have different outer diameters and the compression spring is cone shaped.

In one embodiment, the second pliers body has two connection blocks and the connection blocks protrude toward the first pliers body, the connection blocks are respectively located at two sides of the operating portion, two ends of a bridge member are fixedly connected to the connection blocks, respectively, and the engaging unit of the control member passes through the bridge member.

In one embodiment, the second pliers body comprises a stopping portion near the second pliers portion, when the second pliers body is moved away from the first pliers body, the stopping portion is stopped by a side edge of the operating portion of the first pliers body, so that an expanded angle between the first pliers body and the second pliers body is limited.

In one embodiment, each of the first tooth portions has an inner end adjacent to the elongate hole and an outer end distant from the elongate hole, each of the first tooth portions inclines downwardly from the outer end to the inner end.

In one embodiment, each of the first tooth portions has an inner end adjacent to the elongate hole and an outer end distant from the elongate hole, each of the first tooth portions is arranged that the inner end is closer to the first pliers portion with respect to the outer end.

In one embodiment, each of the first tooth portions has an inner end adjacent to the elongate hole and an outer end distant from the elongate hole, each of the first tooth portions inclines upwardly from the outer end to the inner end.

In one embodiment, each of the first tooth portions has an inner end adjacent to the elongate hole and an outer end distant from the elongate hole, each of the first tooth portions is arranged that the outer end is closer to the first pliers portion with respect to the inner end.

The aforementioned purposes and advantages as well as other purposes and advantages can be understood from the detail description and the appended drawings.

DETAILED DESCRIPTION OF THE PREFERRED EMBODIMENTS

It is understood that, the structures shown in FIGS. 1-14 are exemplary embodiments of the present invention and are only provided for illustrative purposes, the scope of the present invention is not limited by the structures provided in the figures.

Figure 1:
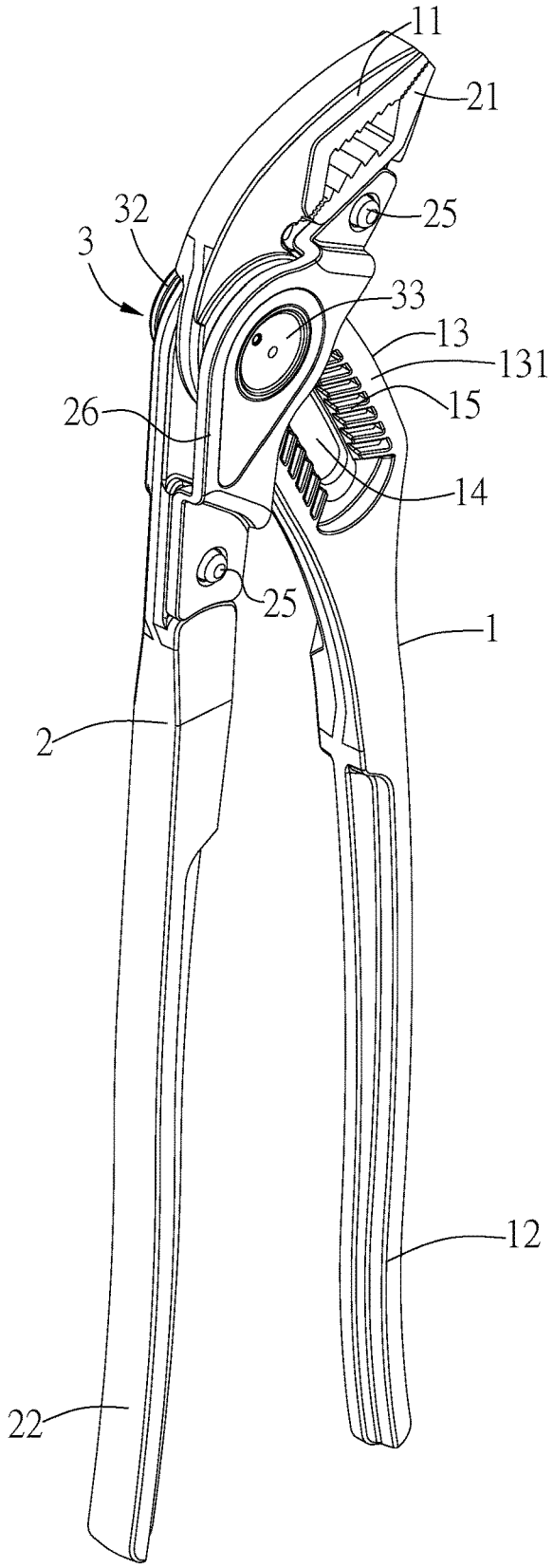
FIG. 1 illustrates a perspective view of a pliers according to an exemplary embodiment of the present invention.
Figure 2:
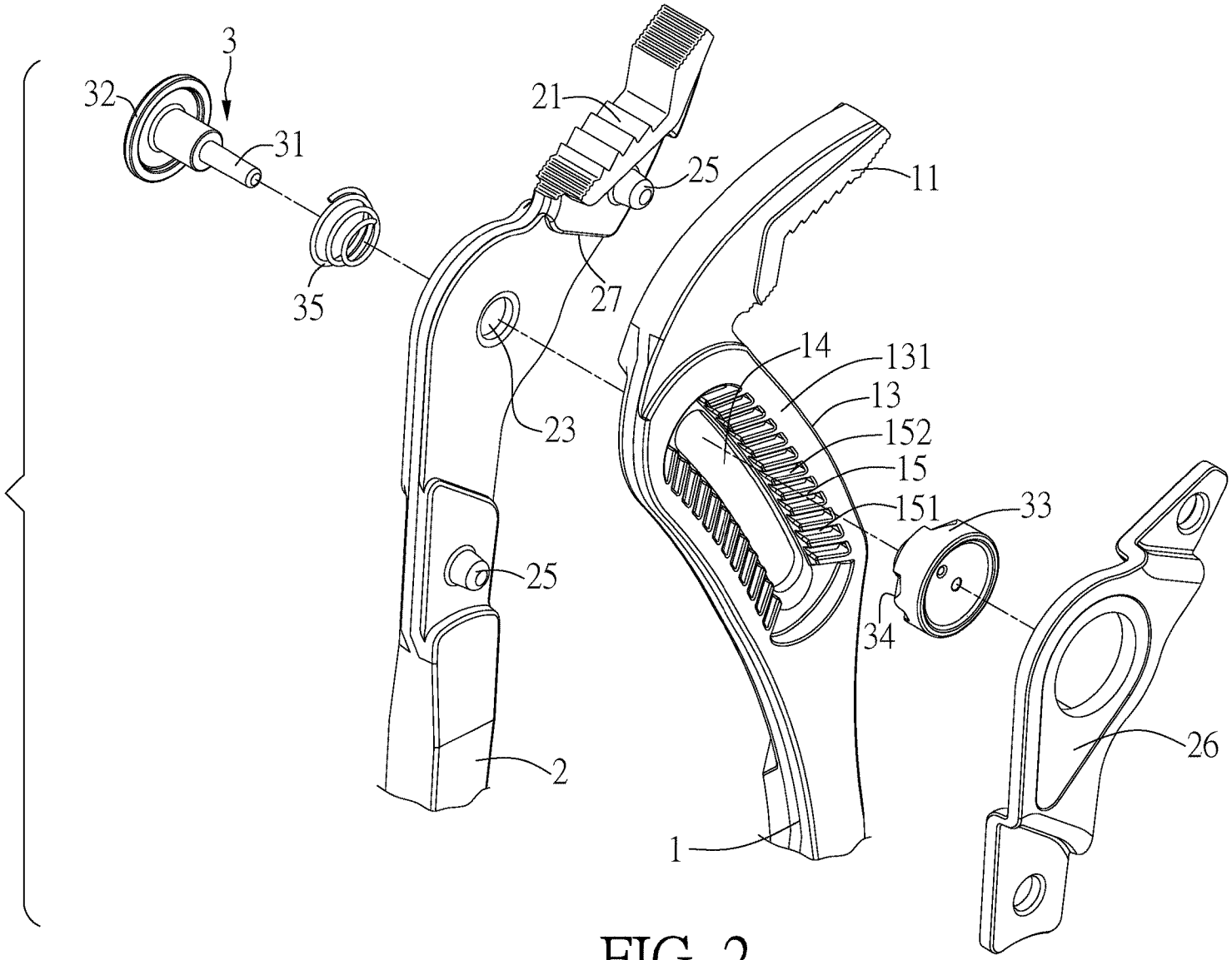
FIG. 2 illustrates an exploded view of the pliers.
Figure 3:
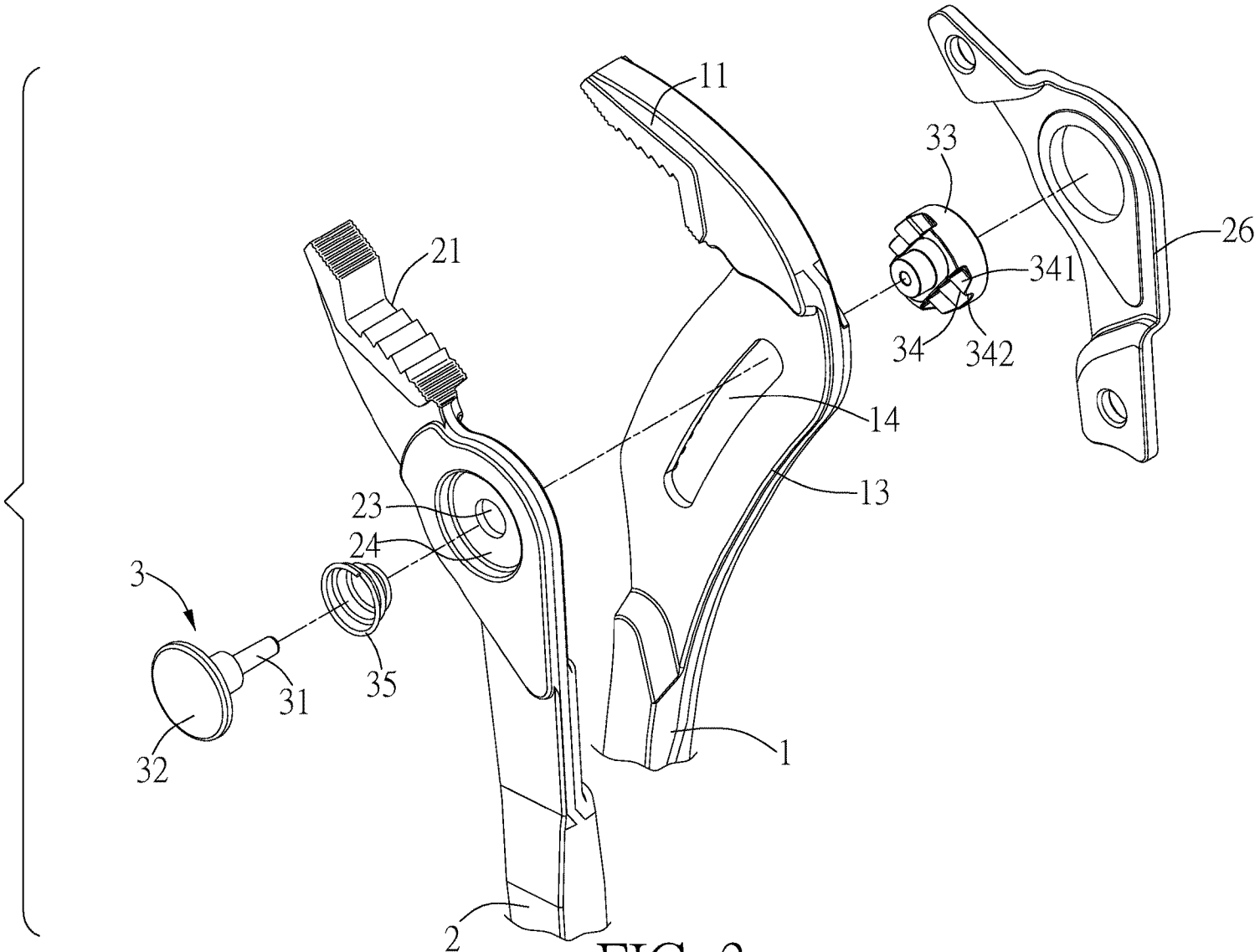
FIG. 3 illustrates another exploded view of the pliers.

The present invention provides a pliers. As shown in FIGS. 1 to 3, the pliers comprises a first pliers body 1, a second pliers body 2, and a control member 3.

As shown in FIGS. 1 to 3, two ends of the first pliers body 1 are respectively a first pliers portion 11 and a first handle portion 12. An operating portion 13 is between the first pliers portion 11 and the first handle portion 12. An elongate hole 14 is provided on a top surface 131 formed on the operating portion 13 and penetrates therethrough. A plurality of first tooth portions 15 is disposed alongside the elongate hole 14 on the top surface 131 and protrudes upwardly from the top surface 131. The first tooth portions 15 are parallel to each other. Each of first tooth portions 15 has a first guiding surface 151 and a first stopping surface 152, the first guiding surface 151 is opposite to the first pliers portion 11 and the first stopping surface 152 faces the first pliers portion 11.

Figure 4:
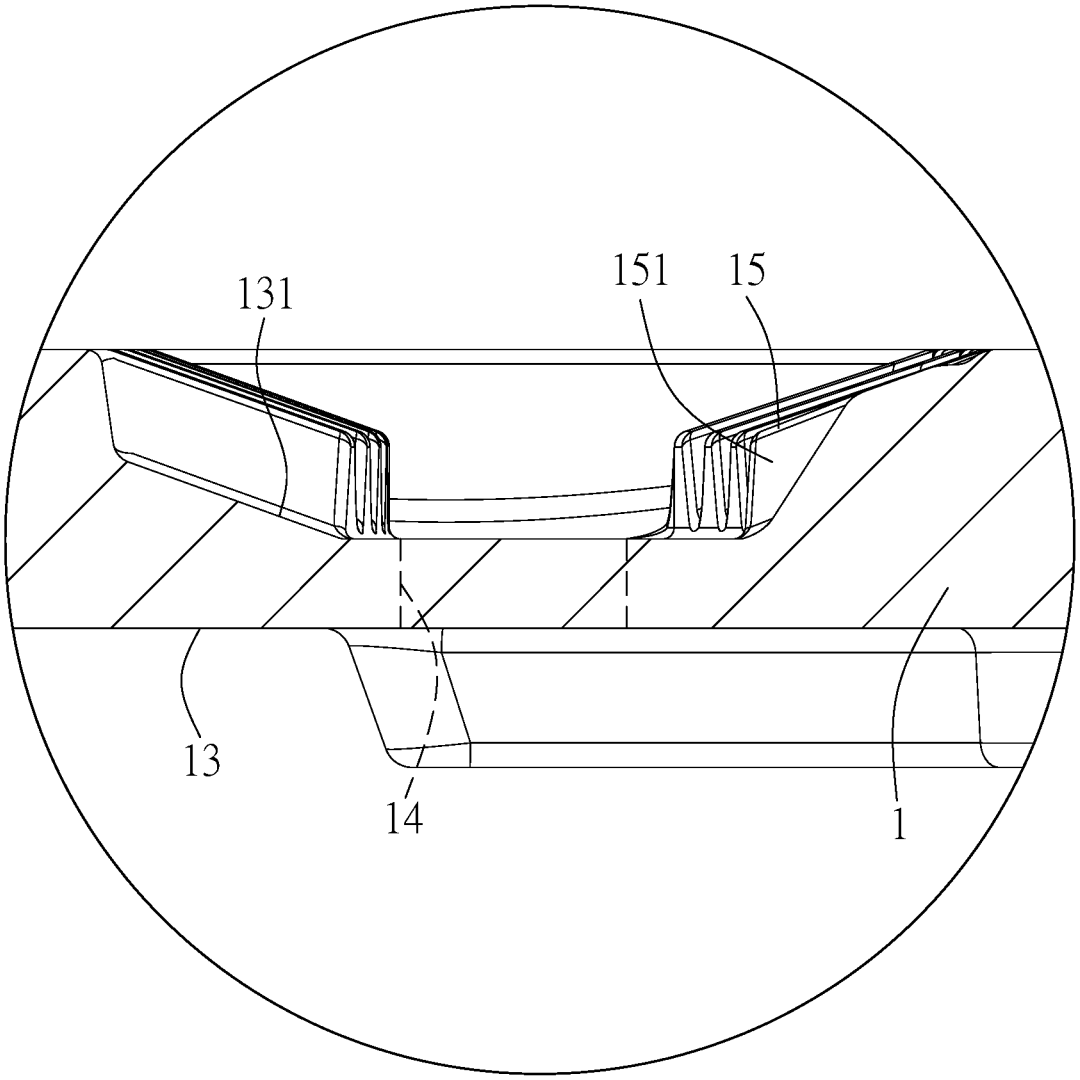
FIG. 4 illustrates a partial enlarged view of an operating portion of a first pliers body showing that each of first tooth portions of the first pliers body inclines toward an elongate hole inwardly from an outer end distant from the elongate hole to an inner end adjacent to the elongate hole.
Figure 5:
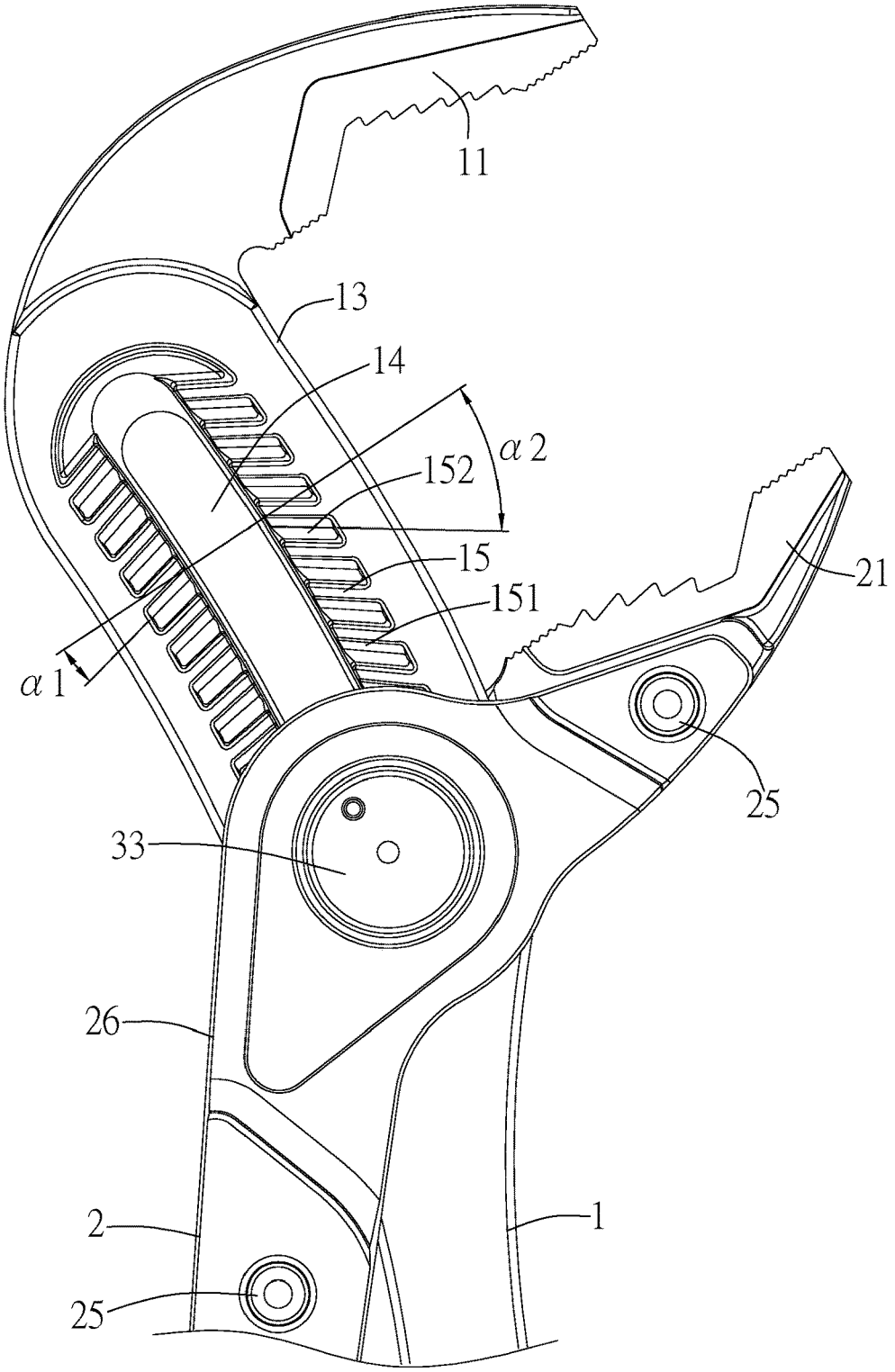
FIG. 5 illustrates a schematic view showing that a second pliers portion is away from a first pliers portion.
Figure 6:
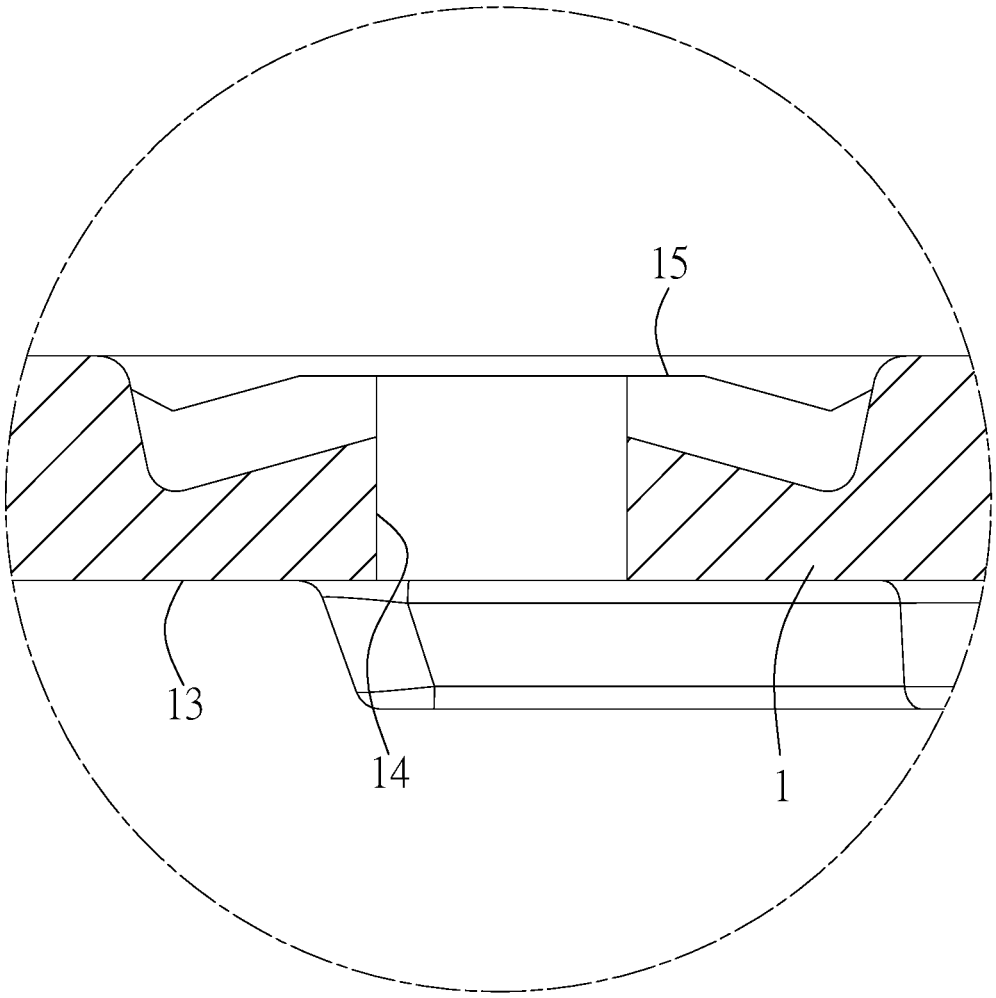
FIG. 6 illustrates a partial enlarged view of an operating portion of a first pliers body showing that each of first tooth portions of the first pliers body inclines toward an elongate hole inwardly from an inner end adjacent to the elongate hole to an inner end distant from the elongate hole, according to another embodiment.
Figure 7:
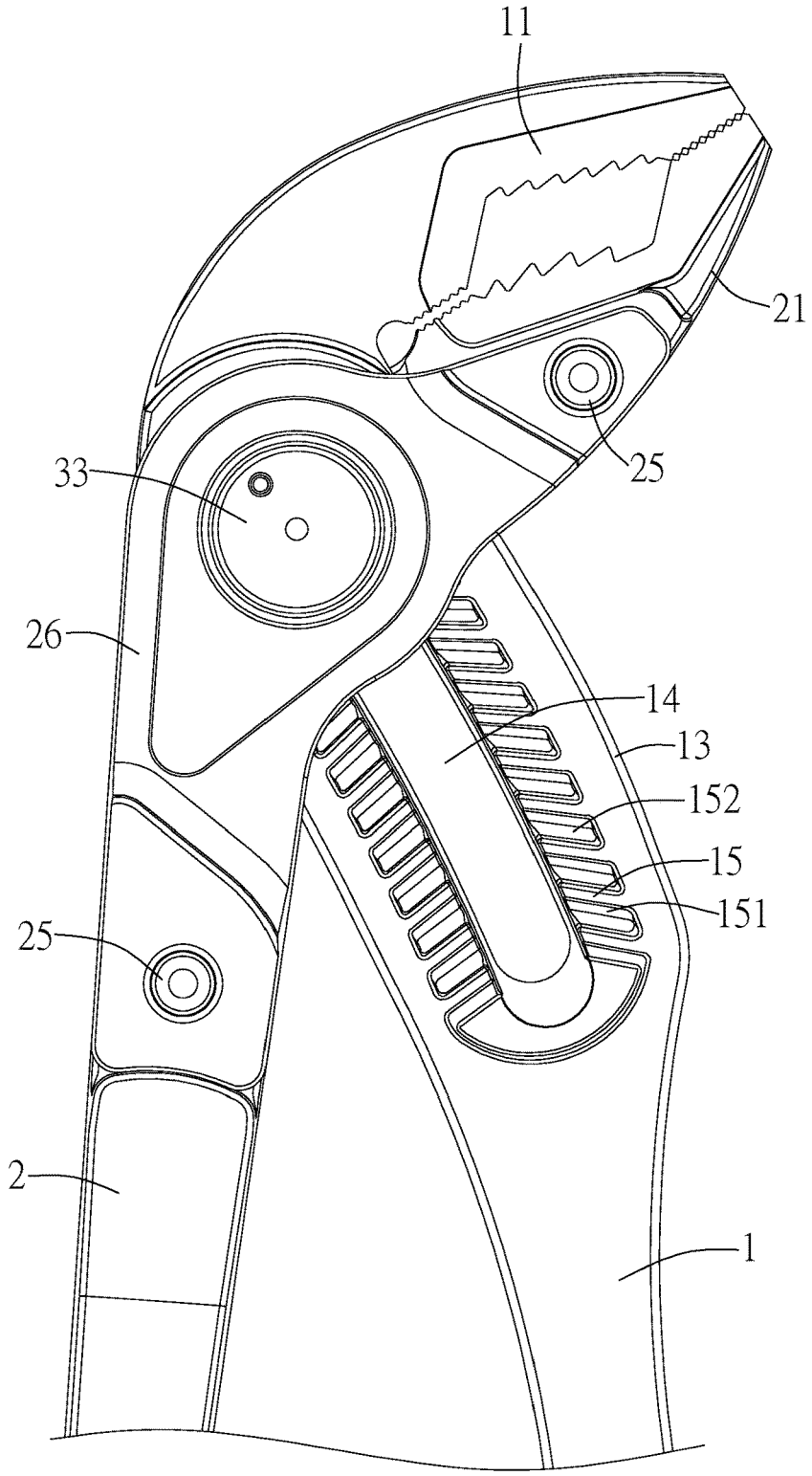
FIG. 7 illustrates a schematic view showing that the first tooth portions tilt toward the first pliers portion in which the outer ends are closer to the first pliers portion with respect to the inner ends, according to the embodiment shown in FIG. 6.

As shown in FIGS. 2, 4, and 5, each of the first tooth portions 15 has an inner end adjacent to the elongate hole 14 and an outer end distant from the elongate hole 14. Each of the first tooth portions 15 inclines downwardly from the outer end to the inner end (called a first state), and each of the first tooth portions 15 is arranged that the inner end is closer to the first pliers portion 11 with respect to the outer end (called a second state). Hence, the first tooth portions 15 at two sides of the elongate hole 14 in a width direction of the elongate hole 14 respectively have $\alpha 1$ and $\alpha 2$ angles, as shown in FIG. 5, and the first tooth portions 15 at the two sides of the elongate hole 14 in the width direction of the elongate hole 14 are arranged into inversed v shapes. Alternatively, as shown in FIG. 6, each of the first tooth portions 15 inclines upwardly from the outer end to the inner end (called a third state), and each of the first tooth portions 15 is arranged that the outer end is closer to the first pliers portion 11 with respect to the inner end (called a fourth state). It is understood that, the configuration of the first tooth portions 15 may be not only the combination of the first and second states and the combination of the third and fourth states but also the combination of the first and fourth states or the combination of the second and third states. Hence, in this embodiment, the first tooth portions 15 may have four different configurations.

As shown in FIGS. 1 to 3, two ends of the second pliers body 2 are a second pliers portion 21 and a second handle portion 22. A through hole 23 is between the second pliers portion 21 and the second handle portion 22. The through hole 23 of the second pliers body 2 is aimed at the elongate hole 14 of the first pliers body 1, and the second pliers body 2 is stacked on the first pliers body 1 in a cross manner.

As shown in FIGS. 1 to 3, the control member 3 has a rod portion 31. An outer diameter of the rod portion 31 is less than a width of the elongate hole 14. Two ends of the rod portion 31 respectively have a pressing block 32 and an engaging unit 33. The engaging unit 33 has several second tooth portions 34 capable of being engaged with the first tooth portions 15. Each of the second tooth portions 34 has a second guiding surface 341 and a second stopping surface 342. The second guiding surfaces 341 correspond to the first guiding surfaces 151 and are respectively slidable relative to the first guiding surfaces 151. The second stopping surfaces 342 correspond to the first stopping surfaces 152 and the first stopping surfaces 152 are respectively stopped by the second stopping surfaces 342.

The rod portion 31 of the control member 3 passes through the through hole 23 and the elongate hole 14. When the pressing block 32 is abutted against an elastic member 35, the pressing block 32 is normally pushed away from the operating portion 13 and the second tooth portions 34 of the engaging unit 33 are normally engaged with the first tooth portions 15 of the operating portion 13. In this embodiment, the second pliers body 2 has a stepped surface 24 corresponding to the pressing block 32, the elastic member 35 is a compression spring, and two ends of the compression spring are respectively abutted against the pressing block 32 and the stepped surface 24. Furthermore, the elastic member 35 may be a compression spring in which two ends of the compression spring have different outer diameters and the compression spring is cone shaped.

In this embodiment, the second pliers body 2 has two connection blocks 25 protruding toward the first pliers body 1, and the connection blocks 25 are respectively located at two sides of the operating portion 13. Two ends of a bridge member 26 are fixedly connected to the connection blocks 25. The engaging unit 33 of the control member 3 passes through the bridge member 26. Furthermore, the second pliers body 2 comprises a stopping portion 27 near the second pliers portion 21. When the second pliers body 2 is moved away from the first pliers body 1, the stopping portion 27 is stopped by a side edge of the operating portion 13 of the first pliers body 1, so that an expanded angle between the first pliers body 1 and the second pliers body 2 is limited.

In operation of the pliers, the pressing block 32 is pressable toward the operating portion 13 until the second tooth portions 34 of the engaging unit 33 are detached from the engaged first tooth portions 15, so that the second pliers body 2 is capable of being pushed forward relative to the first pliers body 1, thereby allowing the second pliers portion 21 moving toward the first pliers portion 11; or the second pliers body 2 is capable of being pulled backward relative to the first pliers body 1, thereby allowing the second pliers portion 21 moving away from the first pliers portion 11. The operation of the pliers of the present invention mentioned herein is the same as the operation of a conventional pliers.

Figure 8:
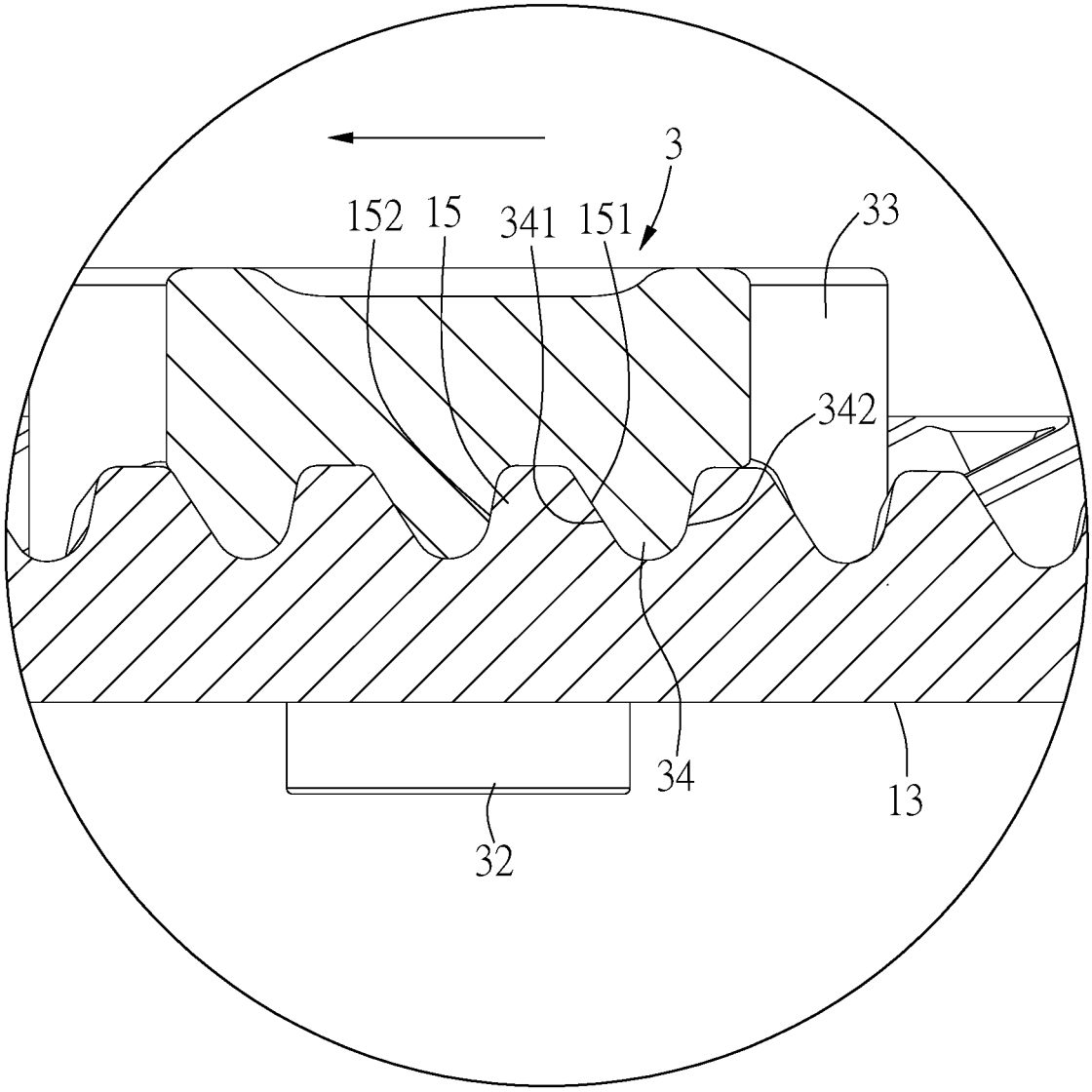
FIG. 8 illustrates a partial sectional view showing that second tooth portions of an engaging unit are engaged with the first tooth portions.
Figure 9:
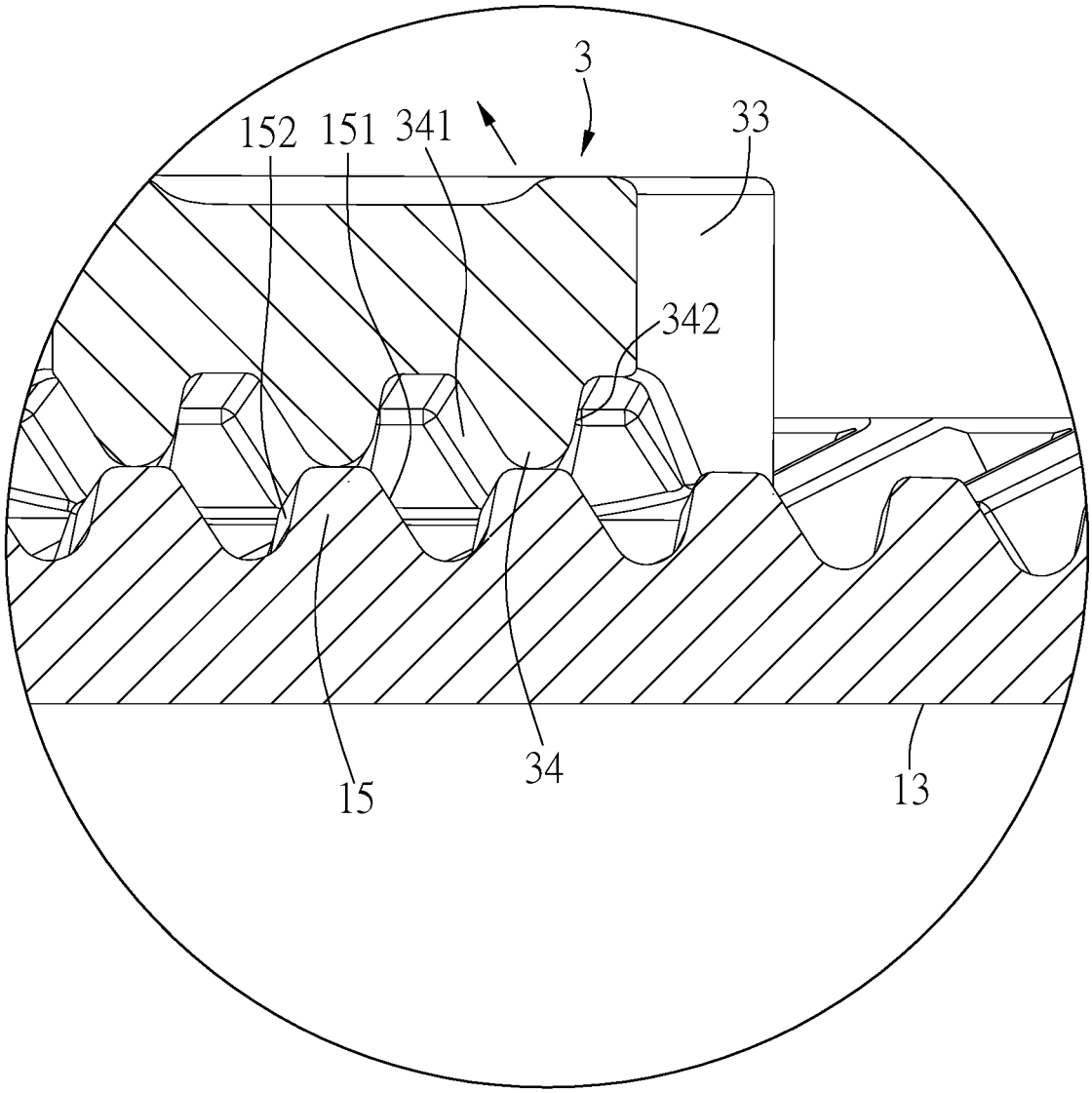
FIG. 9 illustrates a schematic view showing that in the case of FIG. 8, when the second pliers body is pushed forward relative to the first pliers body, second guiding surfaces of the second tooth portions slide relative to first guiding surfaces of the first tooth portions to move the engaging unit upward, so that each of the first tooth portions is moved to engage with a next corresponding second tooth portion.
Figure 10:
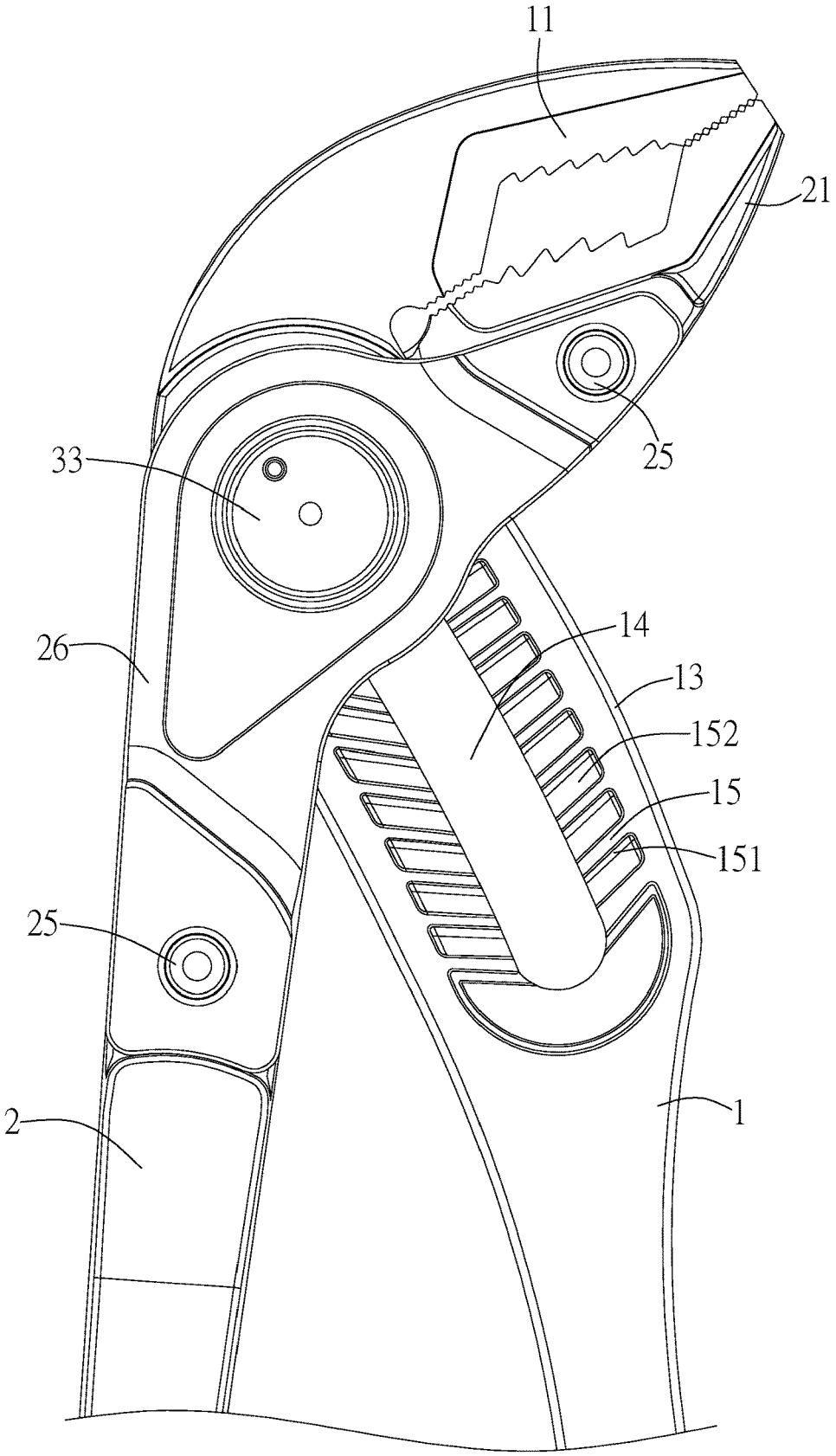
FIG. 10 illustrates a schematic view showing that the second pliers portions is close to the first pliers portion.
Figure 11:
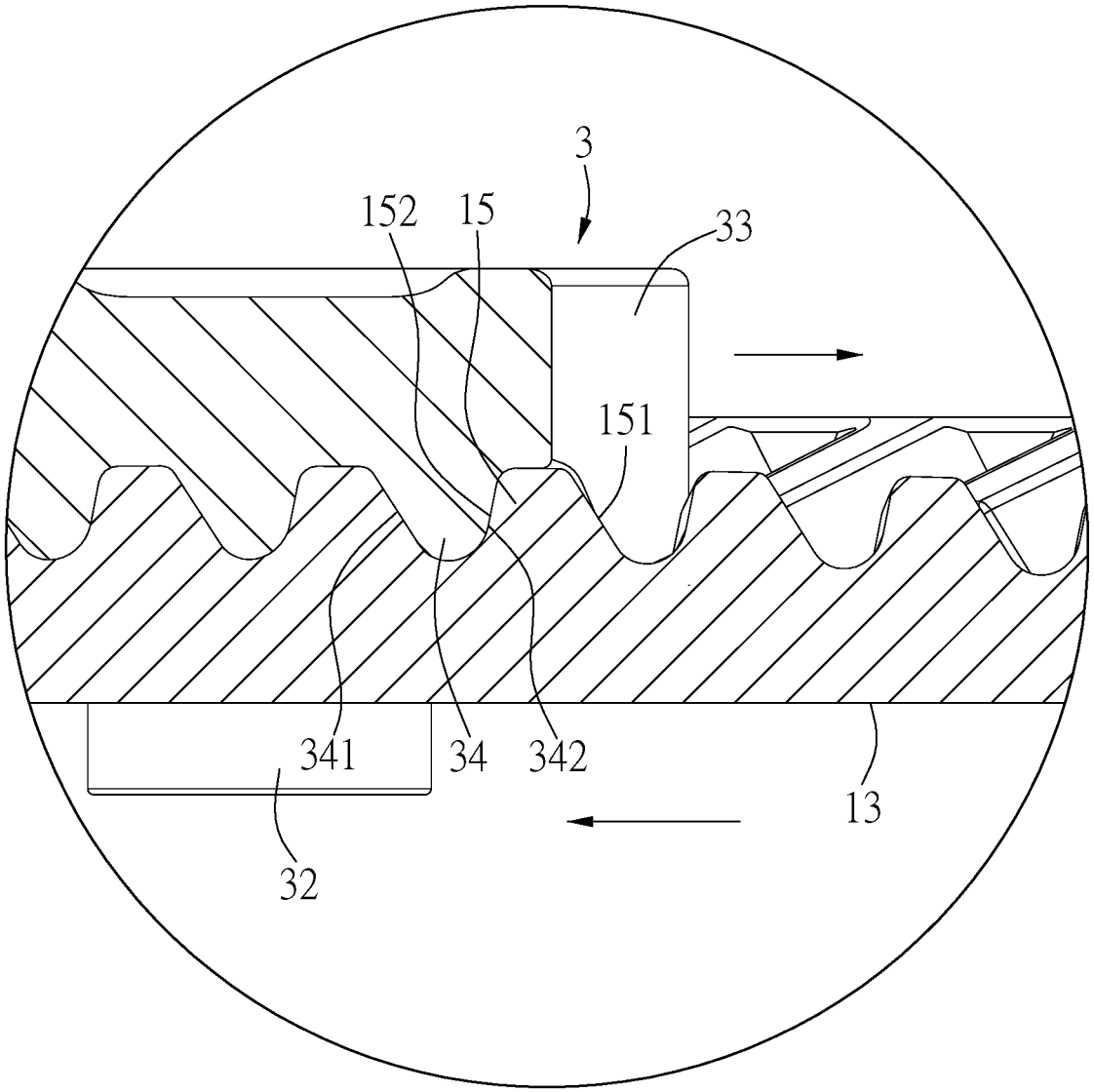
FIG. 11 illustrates a schematic view showing that when the second pliers body is pulled backward relative to the first pliers body, second stopping surfaces of the second tooth portions are stopped by first stopping surfaces of the first tooth portions.

As shown in FIGS. 5 and 8, when the second pliers portion 21 is away from the first pliers portion 11 and the second tooth portions 34 of the engaging unit 33 are engaged with the first tooth portions 15 of the operating portion 13, the second pliers body 2 can be pushed forward relative to the first pliers body 1 without pressing the pressing block 32, so that the second guiding surfaces 341 of the second tooth portions 34 of the engaging unit 33 slide relative to the first guiding surfaces 151 of the first tooth portions 15 (as shown in FIG. 9), and each of the first tooth portions 15 is moved to engage with a next corresponding second tooth portion 34, thereby allowing the second pliers portion 21 being movable toward the first pliers portion 11, until the second pliers portion 21 is attached to the first pliers portion 11, as shown in FIG. 10. Conversely, when the second pliers body 2 is pulled backward relative to the first pliers body 1 without pressing the pressing block 33, as shown in FIG. 11, the second stopping surfaces 342 of the second tooth portions 34 are stopped by the first stopping surfaces 152 of the first tooth portions 15, so that the second pliers portion 21 is not moved away from the first pliers portion 11. Therefore, the first pliers portion 11 is still attached to the second pliers portion 21, and the first pliers portion 11 and the second pliers portion 21 cannot be departed from each other. When the pressing block 32 is pressed again, the second tooth portions 34 are detached from the first tooth portions 15, so that the first pliers portion 11 can be moved away from the second pliers portion 21.

Figure 12:
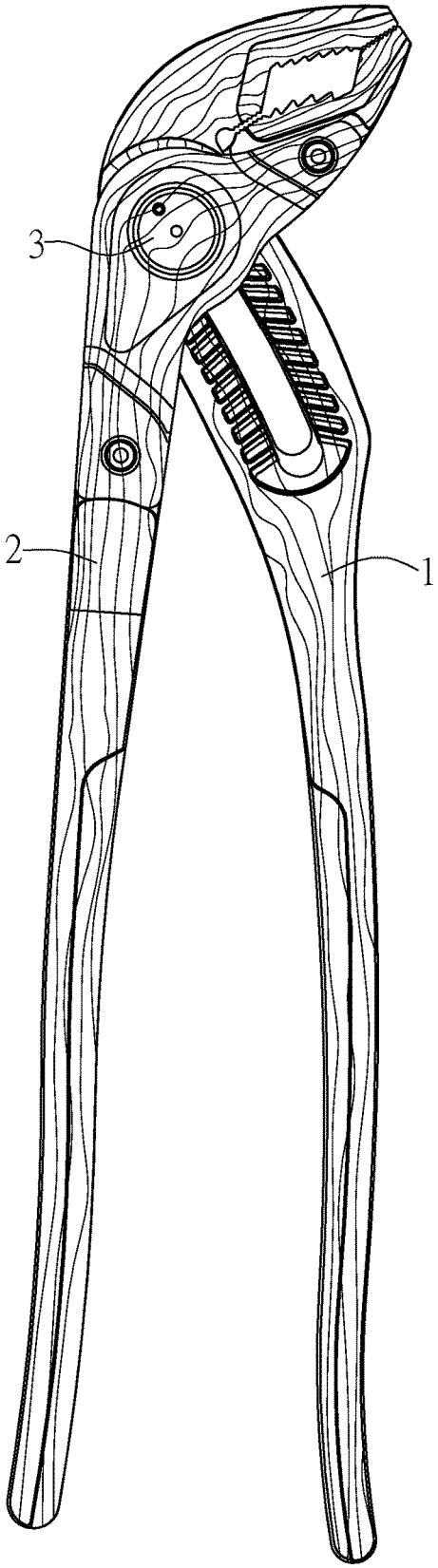
FIG. 12 illustrates a plan view of the pliers showing the forging flow line of the pliers.
Figure 13:
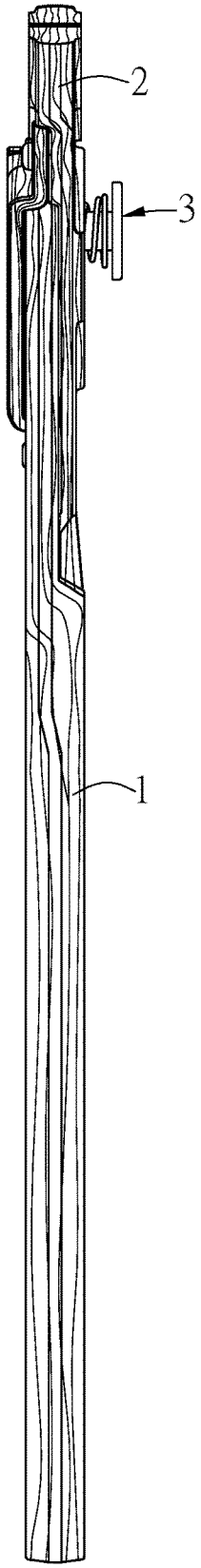
FIG. 13 illustrates another plan view of the pliers showing the forging flow line of the pliers.

As shown in FIGS. 12 and 13, the first pliers body 1 and the second pliers body 2 respectively have forging flow lines along length directions thereof (and the forging flow lines of the bridge member 26 and the pressing block 33 are the same as that of the first pliers body 1 and the second pliers body 2), so that the tenacities of the first pliers body 1 and the second pliers body 2 in the length direction are increased.

As above, the advantages of the present invention are described as following. One side of the first pliers body 11 having the elongate hole 14 has the first tooth portions 15, and the engaging unit 33 of the control member 3 has the second tooth portions 34. When the elastic member 35 is abutted against the pressing block 33 and the second tooth portions 34 are normally engaged with the first tooth portions 15, the second pliers body 2 can be pushed forward relative to the first pliers body 1, so that the second guiding surfaces 341 of the second tooth portions 34 of the engaging unit 33 slide relative to the first guiding surfaces 151 of the first tooth portions 15, and each of the first tooth portions 15 is moved to engage with a next corresponding second tooth portion 34, thereby allowing the second pliers portion 21 being movable toward the first pliers portion 11. Hence, the clamping distance between the first pliers portion 11 and the second pliers portion 21 is adjustable without pressing the pressing block 33 of the control member 3, thereby achieving the convenience for clamping an object in a limited space with the pliers.

Moreover, each of the first tooth portions 15 inclines toward the elongate hole 14 inwardly from the outer end to the inner end (or from the inner end to the outer end) in the width direction of the operating portion 13, and the first tooth portions 15 tilt toward the first pliers portion 11 in which the inner ends are closer to the first pliers portion 11 with respect to the outer ends (or the outer ends are closer to the first pliers portion 11 with respect to the inner ends). The aforementioned tilt configurations allow the length of the first tooth portions 15 increases, as compared with that of the first tooth portions 15 not being tilted. Therefore, the area of the first guiding surfaces 151 is increased to allow the contact area between the second guiding surfaces 341 and the first guiding surfaces 151 to be increased.

Figure 14:
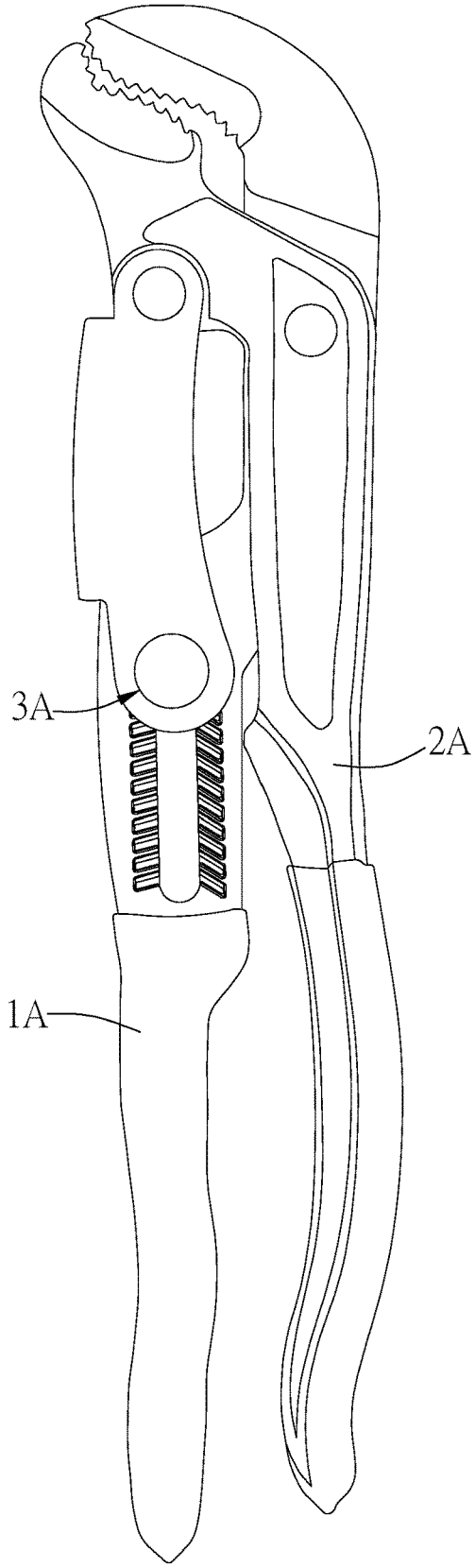
FIG. 14 illustrates a plan view of the pliers, according to another embodiment.
Figure 15:
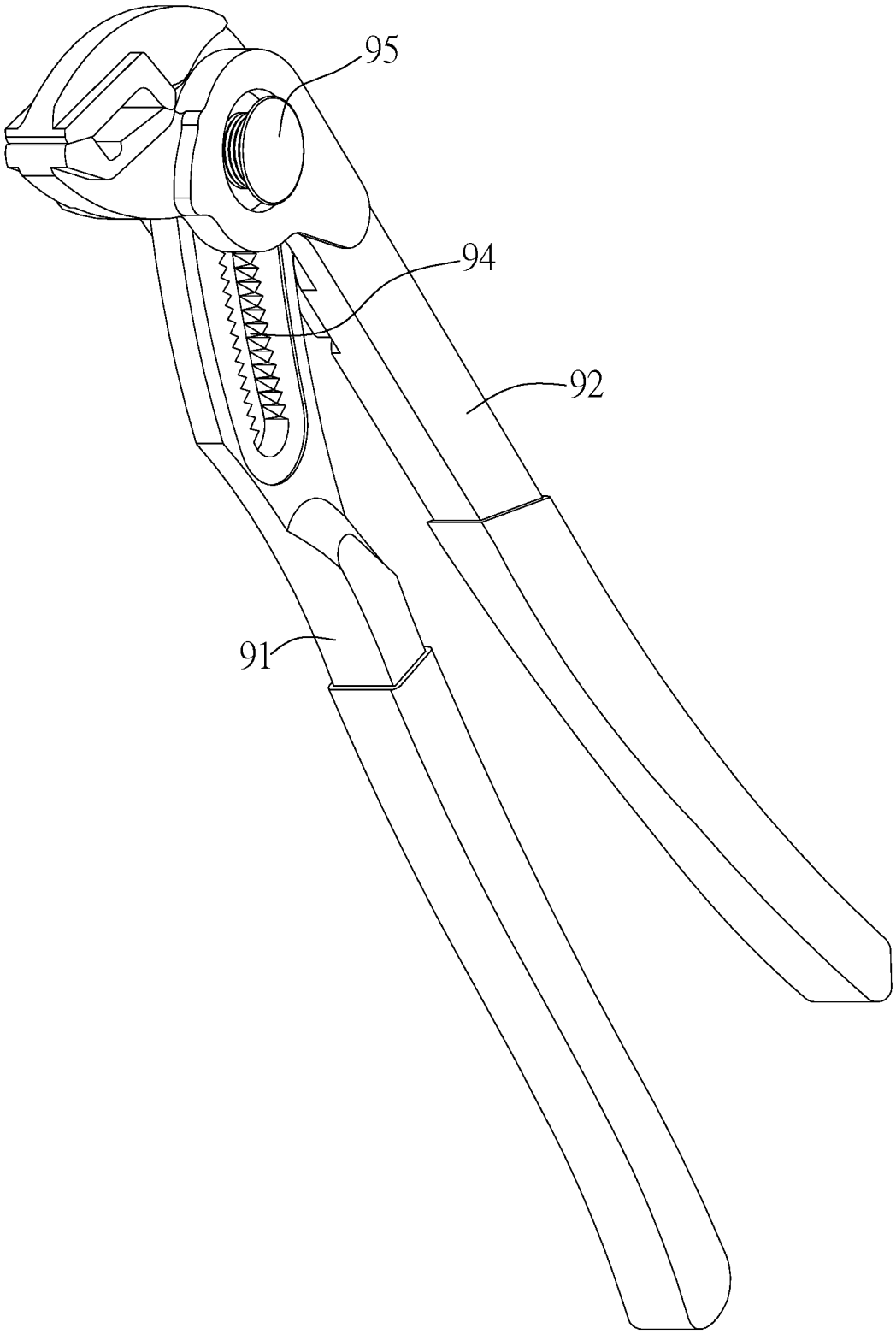
FIG. 15 PRIOR ART
FIG. 15 illustrates a perspective view of a conventional pliers.
Figure 16:
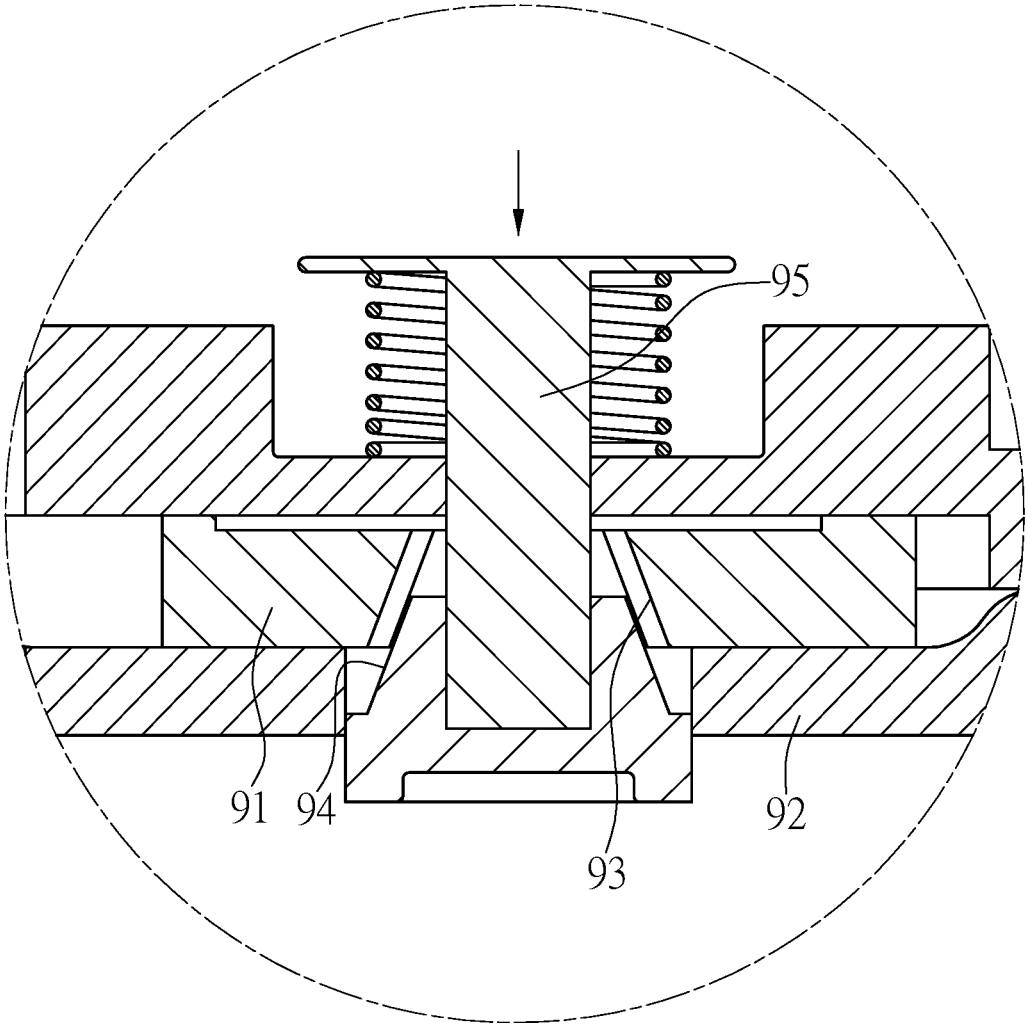
FIG. 16 PRIOR ART
FIG. 16 illustrates a partial sectional view of the conventional pliers showing that a pivot shaft is pressed and moved in a tooth groove, and a tooth portion is detached from the tooth groove.

Please refer to FIG. 14, illustrating another embodiment of the present invention. The pliers comprises a first pliers body 1A, a second pliers body 2A, and a control member 3A. In this embodiment, the appearance of the first pliers body 1A is different from the appearance of the second pliers body 2A. The pliers of this embodiment can also achieve the effects mentioned in the foregoing embodiments.

It is understood that, simple modification and equivalent structure changes of the present invention are also encompassed by the present invention.

What is claimed is:

1. A pliers, comprising:

a first pliers body with a first pliers portion and a first handle portion formed at two ends of the first pliers body respectively and an operating portion formed between the first pliers portion and the first handle portion, an elongate hole penetrating through the operating portion from a top surface thereof; a plurality of first tooth portions parallel arranged alongside the elongate hole on the top surface and protruding upwardly from the top surface, wherein each of the first tooth portions has a first guiding surface opposite to the first pliers portion and a first stopping surface facing the first pliers portion, and each of the first tooth portions tilts toward the elongate hole, wherein each of the first tooth portions has an inner end adjacent to the elongate hole and an outer end distant from the elongate hole, and each of the first tooth portions inclines upwardly from the outer end to the inner end;

a second pliers body with a second pliers portion and a second handle portion formed at two ends of the second pliers body respectively and a through hole formed between the second pliers portion and the second handle portion to be aimed at the elongate hole of the first pliers body, the second pliers body being stacked on the first pliers body in a cross manner; and a control member having a rod portion passing through the through hole and the elongate hole, a pressing block and an engaging unit respectively provided at two ends of the rod portion, an elastic member disposed between and abutted against the pressing block and the second pliers body for pushing the pressing block away from the second pliers body so as to force a plurality of second tooth portions of the engaging unit to engage with the first tooth portions of the operating portion normally; wherein each of the second tooth portions has a second guiding surface for engaging with the first guiding surfaces and sliding thereon and a second stopping surface for engaging with the first stopping surfaces and being stopped thereby.

2. The pliers according to claim 1, wherein the second pliers body has a stepped surface corresponding to the pressing block, wherein the elastic member is a compression spring, and two ends of the compression spring are respectively abutted against the pressing block and the stepped surface.

3. The pliers according to claim 2, wherein the elastic member is a compression spring in which the two ends of the compression spring have different outer diameters and the compression spring is cone shaped.

4. The pliers according to claim 1, wherein the second pliers body has two connection blocks located at two sides of the operating portion and protruding toward the first pliers body, a bridge member is fixedly connected to the connection blocks, the engaging unit of the control member passes through the bridge member.

5. The pliers according to claim 1, wherein the second pliers body comprises a stopping portion near the second pliers portion, when the second pliers body is moved away from the first pliers body, the stopping portion is stopped by a side edge of the operating portion of the first pliers body, so that an expanded angle between the first pliers body and the second pliers body is limited.

6. The pliers according to claim 1, wherein the first pliers body has a forging flow line along a length direction thereof, the second pliers body has a forging flow line along a length direction thereof, so that the tenacities of the first pliers body and the second pliers body in the length direction are increased.

7. The pliers according to claim 1, wherein each of the first tooth portions is arranged such that the inner end is closer to the first pliers portion with respect to the outer end.

8. The pliers according to claim 1, wherein each of the first tooth portions is arranged such that the outer end is closer to the first pliers portion with respect to the inner end.

* * * * *